US006300574B1

(12) United States Patent
Franey

(10) Patent No.: US 6,300,574 B1
(45) **Date of Patent: *Oct. 9, 2001**

(54) CORROSION INHIBITING CAP FOR ELECTRICAL TERMINALS

(75) Inventor: John Philip Franey, Bridgewater, NJ (US)

(73) Assignee: Lucent Technologies Inc., Murray Hill, NJ (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/583,367

(22) Filed: Jan. 5, 1996

(51) Int. Cl.[7] ..... H01B 17/38

(52) U.S. Cl. ..... 174/138 F; 174/75 C; 174/82; 174/85; 439/519; 439/521; 439/901

(58) Field of Search ..... 174/138 F, 74 A, 174/87, 91, 93, 75 B, 82, 83, 85, 75 R, 75 C, 84 S; 439/127, 519, 521, 901, 904

(56) References Cited

U.S. PATENT DOCUMENTS

| | | | | |
|---|---|---|---|---|
| 1,556,966 | | 10/1925 | Selig | 16/441 |
| 1,626,875 | * | 5/1927 | Reiser | 174/87 |
| 2,468,226 | * | 4/1949 | Murphy | 174/35 SM |
| 3,193,615 | * | 7/1965 | Burrows | 174/138 F |
| 3,992,570 | * | 11/1976 | Beinhaur | 174/74 A X |
| 4,717,608 | * | 1/1988 | Meltsch | 174/74 A X |
| 4,944,916 | * | 7/1990 | Franey | 422/8 |
| 5,162,617 | * | 11/1992 | Ferbas | 174/138 F |
| 5,231,250 | * | 7/1993 | Moulton | 174/138 F |

FOREIGN PATENT DOCUMENTS

| | | | | |
|---|---|---|---|---|
| 0557587 | * | 5/1958 | (CA) | 174/138 F |
| 0051109 | * | 5/1982 | (EP) | 174/138 F |
| 0680128A1 | | 4/1994 | (EP) . | |
| 2546677A1 | | 5/1983 | (FR) . | |

* cited by examiner

*Primary Examiner*—Albert W. Paladini
(74) *Attorney, Agent, or Firm*—Gibbons, Del Deo, Dolan, Griffinger & Vecchione

(57) ABSTRACT

A cap for protecting an electrical terminal from corrosion having a base which is insertable upon the terminal, a tapered section designed to guide and surround a mate to the terminal as it is being connected, and a removable top which protects the terminal before connection. The tapered section deforms during the connection operation to surround the mating terminal and seal the connection from corroding species.

24 Claims, 2 Drawing Sheets

CORROSION INHIBITING CAP FOR ELECTRICAL TERMINALS

BACKGROUND OF THE INVENTION

1. Field of the Invention

This invention relates to a cap which fits over one electrical terminal and which seals itself to a mating electrical terminal to inhibit corrosion.

2. Description of Related Art

The concept of an information highway is now developing into hardware which will provide wide bandwidth service to every home and office in the telephone loop plant. The location of this hardware places environmental burdens upon network interface units, particularly with respect to corrosion and its effect upon error free operation. These units, which interconnect the loop plant to interior circuitry must withstand wide temperature excursions and the effects of contamination and moisture. The contaminating species may be air-borne, such as corrosive gases, or they may be particulate contamination, which may become dissolved in water from rain or condensation. Temperature excursions which permit early morning condensation have been found to be particularly offensive because the amount of water is small and the concentration of contaminants is high. Dissolution of some of the contaminate material then forms an acid which corrodes electrical terminals.

Reducing cost is another factor to ensure the universal acceptance of wide-bandwidth systems, so inexpensive connectors have been developed which are intended for indoor use. These are commonly known as "F-type" connectors, and because of their low cost and wide availability; they have also been used in external applications, with unreliable results.

Attempts have been made to protect these connectors by covering them with a cap to exclude the environment, particularly during shipment and installation. The caps are removed upon installation, but corrosive gases and ionic contamination still seep through the threads of the F-type connector and corrode the center conductor. This corrosion layer increases the resistance of the conduction path and causes interference in video or data signals.

Accordingly, there is an increased need in the art for an inexpensive connector which provides reliable, error-free operation over a range of environmental conditions which are to be encountered in the loop plant or any corrosive environment. It would be particularly desirable to use the same inexpensive connector in both interior and exterior applications to minimize cost and inventory. Further, it is desirable to continue using a connector which is already in widespread use by protecting it with an inexpensive cap which will provide corrosion protection before installation and during extended use. In addition, there is a need to minimize the amount of material which is discarded when the connector is mated.

SUMMARY OF THE INVENTION

The present invention relates to an electrical terminal which is protected from corrosive environments by a cap which seals elements which are sensitive to corrosion from gases or electrolytes.

In one embodiment of the invention, a base, tapered section, and top define a volume which is open at the base end. The inner dimension of the base is slightly smaller than the terminal it is intended to protect from corrosion. The base is forced part-way onto this terminal thereby creating an interference fit and seal. When the terminal is to be connected to its mate, the top is removed leaving the tapered section and base attached to the terminal. The mate is guided by the tapered section and forced into the base to create another interference fit and seal. The base, tapered section, and top are made from a polymer, typically polyethylene, and preferably a corrosion intercept reactive polymer. A scored section may be added between the tapered section and the top to ensure separation at that section. An extension section may also be added adjacent to the top to provide more space for the terminal during storage and shipment. The terminal and its mate may provide connection to a battery, an electronic circuit, or a radio frequency circuit. The terminal may be any shape, but more frequently it is rectangular or circular, and it may comprise single or multiple pins.

In another embodiment of the invention, one portion of a connector, either a plug or a receptacle, is capped with the apparatus described above, and they are provided together as an assembly. On installation, the top is removed and the mate is forced into the body to make the connection and create the seal against corrosion.

In still another embodiment of the invention, a polymer cap comprising an annular base, a tapered section, an extended section, and a top define a volume which is open at the base. The base of the cap is adapted to deform around the plug and receptacle of a radio frequency connector.

With this cap, the same inexpensive radio frequency connectors are capable of both indoor and outdoor use, minimizing cost and inventory. The cap provides corrosion protection to the connector in both the mated and unmated condition. The amount of discarded material is also limited to the top of the cap.

These and other features and advantages of the invention will be better understood with consideration of the following detailed description of the preferred embodiments taken in conjunction with the accompanying drawings.

The drawings are not to scale.

DETAILED DESCRIPTION OF THE PREFERRED EMBODIMENTS

The distribution of wideband communications facilities to provide universal service to homes and offices in the telephone loop plant may be accomplished with coaxial or other cables which terminate in a network interface unit. Hardware exists which meets military specifications to resist environmental conditions, but to promote universal service and meet competition, this hardware must also be provided at relatively low cost while ensuring error-free operation. This invention is not limited to connectors adapted to radio frequency operation, because there is also a need to protect terminals in apparatus such as batteries from the effects of corrosion.

Figure 1:
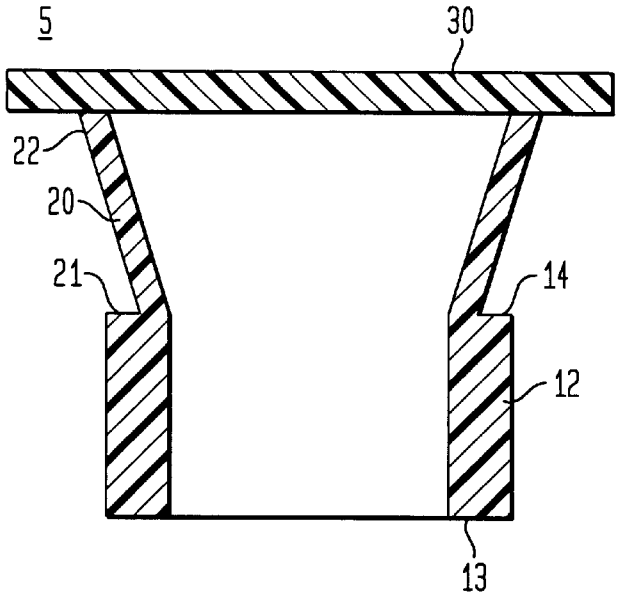
FIG. 1 is a cross sectional view of one embodiment of the invention.

Referring now to FIG. 1, there is shown apparatus 5 which is one embodiment of the invention wherein a polymer base has a sidewall 12, a first end 13, and a second end 14. The second end of the base supports a tapered section having a sidewall 20, a first end 21, and a second end 22. The second end of the tapered section supports top 30. The inner dimension of the base is selected to provide an interference fit around a terminal (not shown) which is to be protected from corrodant species, either gaseous or in dissolved ionic form. In the discussion which follows, the terminal may be rectangular or circular, it may be a single post or it may comprise a multiplicity of pins, it may be a plug or a receptacle, and it may be designed to transmit any signal from DC to radio frequency or microwave frequency. The terminal could therefore be a post of a battery, the connector to an electronic circuit, or a coaxial type connector to a microwave circuit. Typically, the base is an annulus, the tapered section is the frustum of a cone, and the top is circular. The base, tapered section, and the top define a volume which is open at the first end 13 of the base. The base may be selected from the class of any thermoset or thermoplastic materials. An example is polyethylene, and a preferred embodiment is a corrosion intercept reactive polymer. This material is described in U.S. Pat. No. 4,944,916 given to Franey, Jul. 31, 1990, the description of which is incorporated herein. The advantageous property of a corrosion intercept reactive polymer is that it neutralizes corrosive gases by chemical reaction between a sacrificial material in the polymer matrix and corrosive gases such as sulfur or chlorine based compounds. Accelerated tests have shown that a connector which would otherwise be corroded has an expected life of 20 years when protected by the cap.

To protect the terminal before installation and in shipment, apparatus 5 is pushed on to the terminal by placing first end 13 over the terminal. A force is required to slightly expand the inner dimension of the base and to slide it over the terminal. The thickness of sidewall 12 may range from 30 to 100 mils. The dimensions are selected to provide a secure interference fit over a particular terminal thereby protecting it from corrosive species. Apparatus 5 is forced on to the terminal until about half of the sidewall is in contact with the terminal. When a connection is to be made to the terminal, top 30 is torn away from second end 22 of the tapered section. The thickness of sidewall 20 of the tapered section is selected so that the break occurs at second end 22, and the thickness may range from 10 to 40 mils, with a 25 mil thickness being typical. The thickness of the top may range from 50 to 100 mils. The mate to the terminal is then guided by the tapered section toward the base and forced into that portion of the base which is not in contact with the terminal. The mate also makes an interference fit with the base so that the base surrounds both the terminal and its mate and seals their connection from corroding species. A typical interference between the base and the side of the terminal being 5 to 10 mils for a 250 mil diameter terminal.

Figure 2:
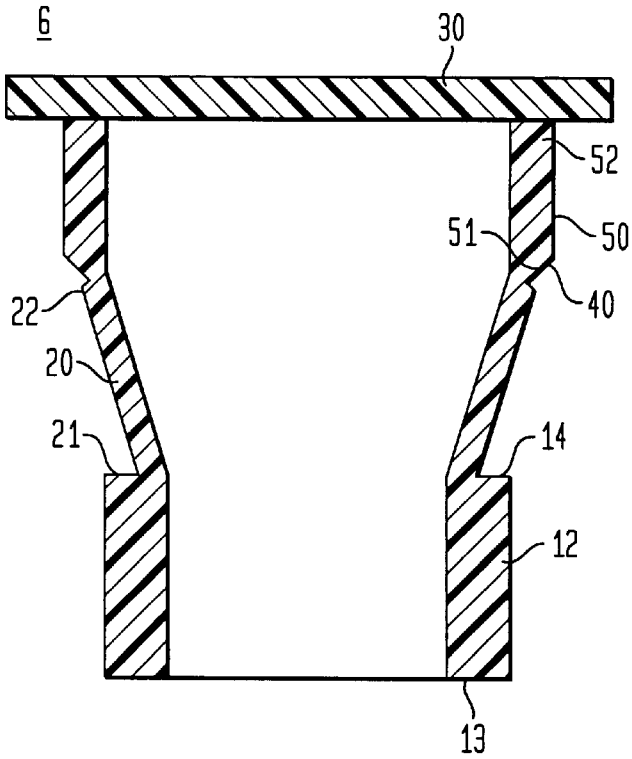
FIG. 2 is a cross sectional view of another embodiment of the invention.

Referring now to FIG. 2, there is shown apparatus 6 in accordance with another embodiment of the invention comprising a base and top section whose elements numbered from 12 to 22 have been described above and are incorporated here. Second end 22 of the tapered section terminates at scored section 40. In this section the thickness of the sidewall is reduced by 30% to 70% to ensure that separation of the tapered section from first end 51 of extension section 50 occurs at the scored section. Second end of the extension section supports top 30. The operation and materials of apparatus 6 is similar to that of apparatus 5. About half of the base is forced over the terminal and the mate is guided by the tapered section toward second end 14 of the base and forced down into the base in an interference fit.

Figure 3:
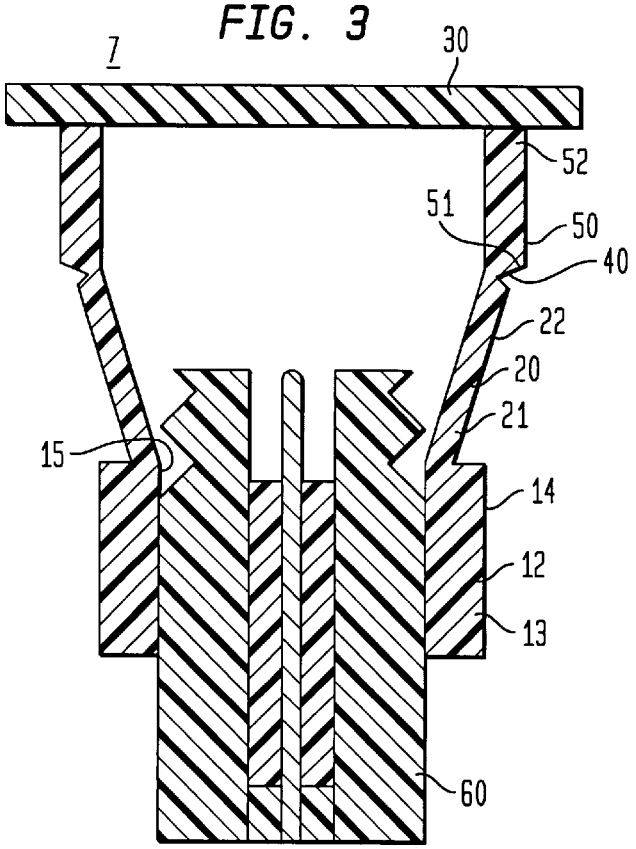
FIG. 3 is a cross sectional view of still another embodiment of the invention.

Referring now to FIG. 3, there is shown capped connector assembly 7 comprising a cap whose elements numbered 12 through 52 have been described in the description of apparatus 6 and are incorporated here. Sidewall 12 of the base surrounds plug 60 which is shown as one component of a connector, in this figure it is shown as a coaxial connector, and the component protected by the cap may be either a plug or a receptacle. Element 60 could also be the terminal of a battery or a multipin connector leading to an electronic circuit. The cap is inserted over plug/receptacle 60 so that portion 15 of sidewall 12 does not contact plug/receptacle 60. When the connection is to be made, top 30 and extension section 50 are removed from tapered section 20 at scored section 40. The mate (91 in FIG. 4) to plug/receptacle 60 is then guided toward second end 14 by the tapered section and it is forced into the base so that portion 15 is expanded to fit around the mate, seal the connection, and protect it from corroding species.

Figure 4:
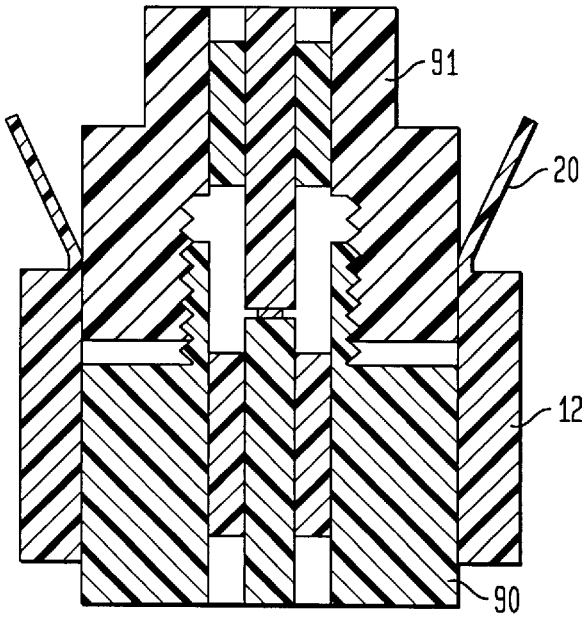
FIG. 4 is a cross sectional view of a mated connector pair protected by the invention.

Referring now to FIG. 4 there is shown by way of example a mated coaxial connector pair comprising plug 90 which is screwed into receptacle 91. Surrounding both of these elements is body 12 which is expanded slightly to create an interference fit between itself and both the plug and receptacle. Corroding species, whether gaseous or ionic, are thereby prevented from reaching and attacking the center conductor and threaded portions of the connector.

The advantages of this structure are that inexpensive connectors which are already in wide use for indoor applications may be applied to outdoor hardware minimizing cost, inventory, and the amount of material discarded.

Changes and modifications in the specifically described embodiments can be carried out without departing from the scope of the invention. In particular, a plug may be used for a receptacle, and vice versa, a terminal may refer to a single pin terminal or to a multipin terminal, and all the aforementioned connectors may be designed to operate from direct current to microwave frequencies. In addition, the cap may be used to protect non-electrical connections such as bolts which are used in mechanical or-civil engineering applications.

I claim:

1. An apparatus for protecting a terminal, said apparatus comprising a housing including a base and a top, said base and top defining a volume sufficient to surround said terminal when said apparatus is disposed on said terminal, said base and top being configured to be separable from one another so as to form a remaining portion and a disposable portion upon separation, said housing being expandable so as to form a seal that protects said terminal from corrosion in at least one of a mated condition and an unmated condition, said mated condition being one wherein said terminal is connected to a mating member and said unmated condition being one wherein said terminal is not connected to said mating member.

2. The apparatus of claim 1, wherein said seal protects said terminal from corrosion in said unmated condition.

3. The apparatus of claim 2, wherein said seal protects said terminal from corrosion in said mated condition when said disposable portion has been separated from said remaining portion.

4. The apparatus of claim 1, wherein said seal protects said terminal from corrosion in said mated condition.

5. The apparatus of claim 4, wherein said connecting of said terminal to said mating member forms a connection that said remaining portion protects from corrosion.

6. The apparatus of claim 1, wherein said remaining portion extends beyond an end of said terminal.

7. The apparatus of claim 1, wherein said remaining portion forms a lateral seal around an endmost portion of said terminal when said terminal is in said unmated condition.

8. The apparatus of claim 7, wherein said remaining portion protects said terminal from corrosion in said mated condition.

9. The apparatus of claim 1, wherein, upon application of said apparatus to said terminal, said top and base protect said terminal from corrosion in said unmated condition.

10. The apparatus of claim 1, wherein said base and top are separable from one another at a predetermined location so as to form said remaining portion and said disposable portion upon separation.

11. The apparatus of claim 10, wherein said top includes a lip to facilitate said separation.

12. The apparatus of claim 11, wherein said housing includes an extension section interposed between said lip and said predetermined location.

13. The apparatus of claim 1, wherein said base has an inner dimension smaller than an outer dimension of said mating member, said expansion resolving the difference between said inner dimension and said outer dimension of said mating member.

14. The apparatus of claim 13, wherein said base has an inner dimension smaller than an outer dimension of said terminal, said expansion resolving the difference between said inner dimension and said outer dimension of said terminal.

15. The apparatus of claim 1, wherein said base is made from a corrosion intercept reactive polymer.

16. The apparatus of claim 1, wherein said housing does not comprise heat-shrinkable material.

17. A method for protecting a terminal, said method comprising the steps of:

providing a housing that includes a base and a top, said base and top defining a volume sufficient to surround said terminal, said base and top being configured to be separable from one another so as to form a remaining portion and a disposable portion upon separation; and expanding said housing so as to form a seal to protect said terminal from corrosion in at least one of a mated condition and an unmated condition, said mated condition being one wherein said terminal is connected to a mating member and said unmated condition being one wherein said terminal is not connected to said mating member.

18. The method of claim 17, further comprising the step of:

separating said base and top from one another to form said remaining portion and said disposable portion.

19. The method of claim 17, wherein said expansion step forms a seal that protects said terminal by forming a seal in both said mated condition and said unmated condition.

20. The method of claim 19, further comprising the step of:

separating said base and top from one another to form said remaining portion and said disposable portion.

21. The method of claim 20 wherein said separating step is performed after said step of expanding said housing so as to protect said terminal from corrosion in said unmated condition.

22. The method of claim 21, wherein said expanding for an unmated condition forms a lateral seal around an endmost portion of said terminal.

23. The method of claim 22, wherein said separating step is performed before said step of expanding said housing so as to protect said terminal from corrosion in said mated condition.

24. The method of claim 19, wherein said base has an inner dimension smaller than an outer dimension of said mating member and an inner dimension smaller than an outer dimension of said terminal;

said seal-forming in said expanding step for said unmated condition occurs by resolving the difference between said inner dimension of said base and said outer dimension of said terminal; and said seal-forming in said expanding step for said mated condition occurs by resolving the difference between said inner dimension of said base and said outer dimension of said mating member.

* * * * *